US009488068B2

(12) United States Patent
Chu et al.

(10) Patent No.: US 9,488,068 B2
(45) Date of Patent: Nov. 8, 2016

(54) APPARATUS FOR CIRCULATING COOLANT IN TURBOCHARGER

(71) Applicants: Hyundai Motor Company, Seoul (KR); Kia Motors Corp., Seoul (KR)

(72) Inventors: Dong Ho Chu, Ansan-si (KR); Seon Yeong Kim, Incheon (KR); Yong Hoon Kim, Seoul (KR); Kwang Sik Yang, Gunpo-si (KR); Hyung Ick Kim, Seoul (KR); Yung Hee Han, Bucheon-si (KR)

(73) Assignees: Hyundai Motor Company, Seoul (KR); Kia Motor Corp., Seoul (KR)

( * ) Notice: Subject to any disclaimer, the term of this patent is extended or adjusted under 35 U.S.C. 154(b) by 49 days.

(21) Appl. No.: 14/333,116

(22) Filed: Jul. 16, 2014

(65) Prior Publication Data

US 2015/0147197 A1 May 28, 2015

(30) Foreign Application Priority Data

Nov. 27, 2013 (KR) ..... 10-2013-0145553

(51) Int. Cl.

| | |
|---|---|
| ***F02B 33/44*** | (2006.01) |
| ***F01D 25/12*** | (2006.01) |
| ***F01P 3/20*** | (2006.01) |
| ***F01P 11/04*** | (2006.01) |
| *F02B 39/00* | (2006.01) |
| *F01P 7/14* | (2006.01) |

(52) U.S. Cl.

CPC ..... *F01D 25/12* (2013.01); *F01P 3/20* (2013.01); *F01P 11/04* (2013.01); *F01P 2007/143* (2013.01); *F01P 2060/12* (2013.01); *F02B 39/005* (2013.01)

(58) Field of Classification Search

CPC .. F02B 39/14; F02B 39/005; F02B 29/0443; F02B 29/0406; F01M 2011/021; F01D 25/12; F01P 3/20; F01P 11/04

USPC ..... 60/605.3, 599; 123/563

See application file for complete search history.

(56) References Cited

U.S. PATENT DOCUMENTS

| | | | | |
|---|---|---|---|---|
| 3,927,530 | A * | 12/1975 | Braun | 60/607 |
| 3,978,671 | A * | 9/1976 | Gonzalez | 60/605.3 |
| 4,058,981 | A * | 11/1977 | Henson | 60/605.3 |
| 4,422,295 | A * | 12/1983 | Minami et al. | 60/605.3 |
| 4,559,782 | A * | 12/1985 | Ritchey et al. | 60/605.3 |
| 4,798,523 | A * | 1/1989 | Glaser et al. | 417/407 |
| 4,969,332 | A * | 11/1990 | Nancarrow et al. | 60/608 |
| 5,275,133 | A * | 1/1994 | Sasaki | F02B 39/005 60/605.3 |
| 5,598,705 | A | 2/1997 | Uzkan | |
| 6,092,371 | A * | 7/2000 | Feucht et al. | 60/602 |
| 6,213,062 | B1 | 4/2001 | Kawase | |
| 6,745,568 | B1 * | 6/2004 | Squires | 60/605.3 |

(Continued)

FOREIGN PATENT DOCUMENTS

| | | |
|---|---|---|
| EP | 0 383 172 A2 | 8/1990 |
| EP | 2 375 029 A1 | 10/2011 |

(Continued)

*Primary Examiner* — Nicholas J Weiss
*Assistant Examiner* — Ngoc T Nguyen
(74) *Attorney, Agent, or Firm* — Morgan, Lewis & Bockius LLP

(57) ABSTRACT

An apparatus circulates a coolant in a turbocharger, which includes a first coolant line for supplying the coolant to the turbocharger from a water pump and configured to form a first flow resistance member to increase flow resistance to the coolant flowing through the first coolant line.

4 Claims, 4 Drawing Sheets

(56) References Cited

U.S. PATENT DOCUMENTS

| | | | | |
|---|---|---|---|---|
| 7,476,090 | B2 * | 1/2009 | Wood | 417/407 |
| 7,647,156 | B2 * | 1/2010 | Mischler et al. | 701/102 |
| 8,015,810 | B2 * | 9/2011 | Theobald | 60/605.3 |
| 8,590,306 | B2 * | 11/2013 | Niwa et al. | 60/605.3 |
| 2007/0234997 | A1 * | 10/2007 | Prenger | 123/196 S |
| 2009/0194044 | A1 * | 8/2009 | Nishida | 123/41.02 |
| 2010/0313561 | A1 * | 12/2010 | Niwa et al. | 60/602 |
| 2012/0067306 | A1 * | 3/2012 | Mehring | F01P 3/12 123/41.72 |
| 2013/0129489 | A1 * | 5/2013 | Spix et al. | 415/175 |
| 2015/0027117 | A1 * | 1/2015 | Benson | 60/605.3 |

FOREIGN PATENT DOCUMENTS

| | | | |
|---|---|---|---|
| EP | 2 453 119 | A1 | 5/2012 |
| EP | 2 458 173 | A1 | 5/2012 |
| EP | 2 557 292 | A1 | 2/2013 |
| JP | 2010048187 | A | 3/2010 |
| JP | 2013-47488 | A | 3/2013 |
| KR | 10-1996-0041643 | A | 12/1996 |
| KR | 1019990056519 | A | 7/1999 |
| KR | 1020020044596 | A | 6/2002 |
| KR | 100816863 | A | 3/2008 |

* cited by examiner

APPARATUS FOR CIRCULATING COOLANT IN TURBOCHARGER

CROSS-REFERENCE TO RELATED APPLICATION

The present application claims priority of Korean Patent Application Number 10-2013-0145553 filed on Nov. 27, 2013, the entire contents of which application are incorporated herein for all purposes by this reference.

BACKGROUND OF INVENTION

1. Field of Invention

The present invention relates to an apparatus for circulating a coolant in a turbocharger, and more particularly to an apparatus for circulating a coolant which prevents factors causing noise made by a coolant flowing into a turbocharger by structurally stopping the coolant from flowing into a hot turbocharger in idling state of a vehicle that is started again.

2. Description of Related Art

When the engine is stopped after a vehicle is driven, the coolant in a turbocharger is evaporated and discharged and the turbocharger keeps hot.

FIG. 1 shows a circulation system of a coolant for a turbocharger according to the related art, in which when a vehicle is started again with a state of hot turbocharger 1, shock waves are generated due to boiling-over of a coolant flowing into the hot turbocharger 1, so resultant vibration is transmitted to a heater core 2 and noise is generated.

In order to reduce the noise, in the related art, an electric water pump was further used to reduce boiling-over of a coolant by reducing the temperature of a bearing housing, by continuously supplying the coolant to a turbocharger for a predetermined time even after an engine is started.

However, there was a problem in the related art in that an electric water pump is additionally used, so the cost and weight are increased.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

The present invention has been made in an effort to provide an apparatus for circulating a coolant in a turbocharger which prevents factors causing noise made by a coolant flowing into a turbocharger by structurally stopping the coolant from flowing into a hot turbocharger in idling state of a vehicle that is started again.

Various aspects of the present invention provide an apparatus for circulating a coolant in a turbocharger, which includes a first coolant line for supplying the coolant to the turbocharger from a water pump and configured to form a first flow resistance member to increase flow resistance to the coolant flowing through the first coolant line.

One end of the first coolant line may be connected to the water pump and the other end is connected to the turbocharger, and the first flow resistance member may be formed by having the first coolant line longer than a minimum length between the water pump and the turbocharger. The first flow resistance member may be formed by bending a middle portion of the first coolant line, by bending a middle portion of the first coolant line at two or more positions, and/or by having a highest position of a middle portion of the first coolant line higher than a position of the other end of the first coolant line connected to the turbocharger.

The apparatus may further include a second coolant line for circulating the coolant from the turbocharger to an engine. One end of the second coolant line may be connected to the turbocharger and the other end may be connected to a coolant circulation channel connected between the water pump and the engine.

The apparatus may further include a second flow resistance member that is disposed in the second coolant line and increases flow resistance against the coolant flowing through the second coolant line. The second flow resistance member may include an orifice that has an inner diameter smaller than an inner diameter of the second coolant line and is disposed at an end of the second coolant line.

According to the present invention, it is possible to eliminate or reduce the noise caused by the coolant flowing into the turbocharger by structurally stopping the coolant from flowing into the turbocharger at a high temperature, using the first coolant line and/or the second coolant line, when starting again a vehicle.

Further, it is possible to preclude noise from being transmitted to the interior due to shock sound or shock wave transmitted into the engine, even if shock noise due to boiling of the coolant is transmitted to the turbocharger, by connecting the second coolant line to the coolant line for the engine.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

Figure 1:
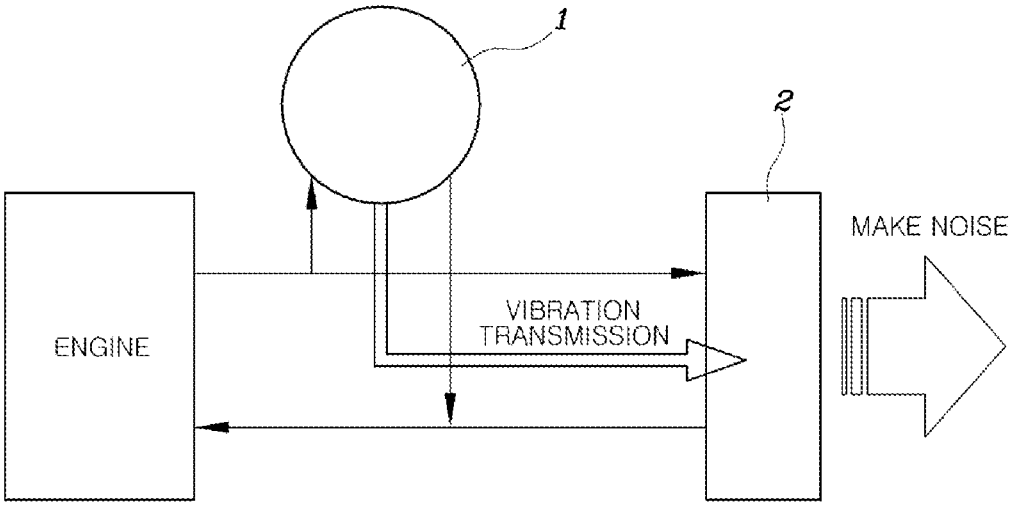
FIG. 1 Related Art
FIG. 1 is a view illustrating the circulation system of a coolant for a turbocharger according to the related art.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 2:
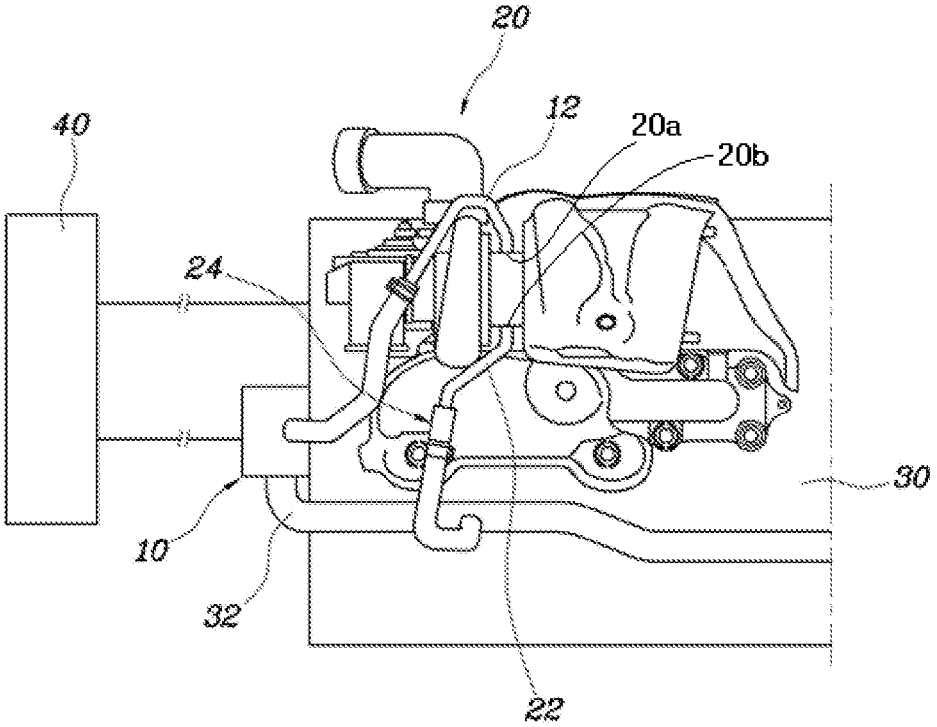
FIG. 2 is a view illustrating a configuration of an exemplary apparatus for circulating a coolant in a turbocharger according to the present invention.
Figure 3:
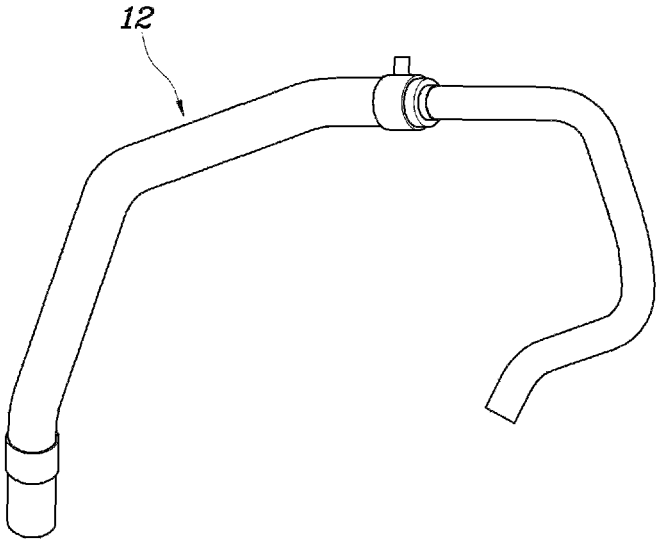
FIG. 3 is a view showing an exemplary first coolant line according to the present invention.
Figure 4:
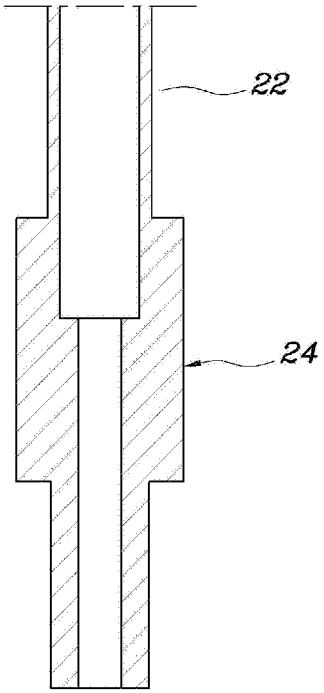
FIG. 4 is a view illustrating a structure of an exemplary orifice in a second coolant line according to the present invention.

FIG. 2 is a view illustrating the configuration of an apparatus for circulating a coolant in a turbocharger, FIG. 3 is a view showing an example of a first coolant line, and FIG. 4 is a view illustrating the structure of an orifice in a second coolant line 22 according to various embodiments of the present invention.

An apparatus for circulating a coolant largely includes a first coolant line 12 and a first flow resistance member. Referring to FIG. 2, the apparatus for circulating a coolant in a turbocharger of the present invention includes: a first coolant line 12 for supplying a coolant to a turbocharger 20 from a water pump 10; and a first flow resistance member disposed in the first coolant line 12 and increasing flow resistance against the coolant flowing through the first coolant line 12. The first coolant line 12 may be a coolant pipe through which a coolant can flow.

That is, when a vehicle stops traveling, the turbocharger 20 is hot due to high-speed rotation of a turbine and the temperature of the exhaust gases, and when the engine of the vehicle is stopped, a water pump 10 is also stopped and the coolant in a bearing housing is evaporated and discharged by the high temperature of the turbocharger 20.

Then, when the engine 30 becomes idle by starting again the vehicle before the temperature of the turbocharger 20 drops, the water pump 10 operates and starts pumping the coolant, but a head loss in the first coolant line 12 is increased by the first flow resistance member in the first coolant line 12 and the coolant is prevented from being supplied to the turbocharger 20 through the first coolant line 12.

Accordingly, it is possible to prevent factors causing noise made by a coolant flowing into the turbocharger 20 by structurally stopping the coolant from flowing into the high-temperature turbocharger 20, when starting again a vehicle.

In this process, the coolant cannot flow into the turbocharger 20 with the engine 30 keeping idling, and an increase in temperature of the turbocharger 20 is very small in the idle state even though the coolant cannot flow into the turbocharger, so a problem due to overheating is not generated in the turbocharger 20.

However, when the vehicle travels at a predetermined speed or more, the pumping pressure of the water pump 10 increases and the coolant flows into the turbocharger 20, but in this case, the boiling noise of the coolant generated in the turbocharger is absorbed in the environment noise due to traveling of the vehicle, so it is not a problem.

On the other hand, in the present invention, one end of the first coolant line 12 may be connected to the water pump 10 and the other end may be connected to the turbocharger 20. That is, both ends of the first coolant line 12 are connected to the exit of the water pump 10 and the coolant inlet 20*a* of the turbocharger 20, respectively, and accordingly, the coolant pumped by the water pump 10 can be supplied to the turbocharger 20 through the first coolant line 12.

FIG. 3 is a view showing an example of the first coolant line 12. Referring to FIG. 3, the first flow resistance member may be formed by having the length of the first coolant line 12 longer than the minimum length between the water pump 10 and the turbocharger 20.

In detail, in the first flow resistance member, the middle portion of the first coolant line 12 is configured to be bent and the length of the first coolant line 12 becomes longer than the minimum length, so the head loss in the first coolant line 12 increases, thereby increasing flow resistance against the coolant. Further, the middle portion of the first coolant line 12 may be configured to be bent at two or more positions. That is, it may be bent at the middle portion in an approximate U-shape. Further, the highest position of the middle portion of the first coolant line 12 may be higher than the position of the other end of the first coolant line 12 connected to the turbocharger 20.

That is, the coolant should rise up to a position higher than the position where the coolant flows into the turbocharger 20 in order for the coolant discharged from the water pump 10 to be supplied to the turbocharger 20, so the flow resistance against the coolant flowing through the first coolant line 12 can be more increased.

The present invention may further include a second coolant line 22 for circulating a coolant from the turbocharger 20 to the engine 30. The second coolant line 22 may be a coolant pipe through which a coolant can flow.

In detail, one end of the second coolant line 22 may be connected to an coolant outlet 20*b* of the turbocharger 20 and the other end may be connected to a coolant circulation channel 32 connected between the water pump 10 and the engine 30. The coolant circulation channel 32 may be an inlet pipe. That is, both ends of the second coolant line 22 are connected to the exit of the turbocharger 20 and the engine 30, respectively, so the coolant that has passed through the turbocharger 20 can be circulated to the engine 30 through the second coolant line 22.

Accordingly, even if shock sound is transmitted to the turbocharger 20, the shock sound is transmitted not to a heater core 40, but into the engine 30; therefore, noise is not transmitted to the heater core 40, so noise is precluded from being transmitted to the interior.

Further, the present invention may further include a second flow resistance member that is disposed in the second coolant line 22 and increases flow resistance against the coolant flowing through the second coolant line 22.

FIG. 4 is a view illustrating the structure of an orifice 24 in the second coolant line 22 according to the present invention. Referring to FIG. 4, in the second flow resistance member, an orifice 24 with an inner diameter smaller than the inner diameter of the second coolant line 22 may be disposed at an end of the second coolant line 22.

That is, the orifice 24 making the channel for coolant smaller is disposed in the second coolant line 22, so the head loss increases not only in the second coolant line 22, but also in the first coolant line 12, and accordingly, the coolant is further prevented from flowing into the turbocharger 20 in idling of a vehicle that is started again.

For convenience in explanation and accurate definition in the appended claims, the terms "inner" or "outer", "higher" or "lower", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An apparatus for circulating a coolant in a turbocharger, comprising:

a first coolant line for supplying the coolant to the turbocharger from a liquid pump, and configured to form a first flow resistance member configured to increase flow resistance to the coolant flowing through the first coolant line, wherein a first end of the first coolant line is connected to the liquid pump and a second end thereof is connected to the turbocharger, and the first flow resistance member is formed by having the first coolant line longer than a minimum length between the liquid pump and the turbocharger and by bending a middle portion of the first coolant line, a second coolant line circulating the coolant from the turbocharger to an engine; and a second flow resistance member disposed in the second coolant line and increasing flow resistance against the coolant flowing through the second coolant line, wherein the second coolant line includes at least two sections having different inner diameters, and an inner diameter of a first section among the at least two sections is smaller than an inner diameter of a second section of the second coolant line adjacent to the first section to form the second flow resistance member, and wherein a coolant inlet of the turbocharger is disposed higher than a coolant outlet of the turbocharger, the second end of the first coolant line is connected with the coolant inlet of the turbocharger, and a first end of the second coolant line is connected with a coolant outlet of the turbocharger.

2. The apparatus of claim 1, wherein the first flow resistance member is formed by bending a middle portion of the first coolant line at two or more positions.

3. The apparatus of claim 1, wherein the first flow resistance member is formed by having a highest position of a middle portion of the first coolant line higher than a position of the second end of the first coolant line connected to the turbocharger.

4. The apparatus of claim 1, wherein a second end of the second coolant line is connected to a coolant circulation channel connected between the liquid pump and the engine.

* * * * *